US006241528B1

(12) United States Patent
Myers

(10) Patent No.: US 6,241,528 B1
(45) Date of Patent: Jun. 5, 2001

(54) REUSABLE WRITING TABLE

(76) Inventor: Edwin C. Myers, 14566 NW. 110th St., Whitewater, KS (US) 67154

( * ) Notice: Subject to any disclaimer, the term of this patent is extended or adjusted under 35 U.S.C. 154(b) by 0 days.

(21) Appl. No.: 09/429,661

(22) Filed: Oct. 29, 1999

(51) Int. Cl.[7] ..... B43L 1/00

(52) U.S. Cl. ..... 434/408; 434/85; 434/422; 434/423; 434/425

(58) Field of Search ..... 434/408, 85, 87, 434/88, 89, 365, 368, 370, 413, 414, 416, 419, 422, 423, 425, 427, 430, 162, 163; 402/79, 500; 283/37; 281/38; 206/555, 454, 449

(56) References Cited

U.S. PATENT DOCUMENTS

| | | | | |
|---|---|---|---|---|
| 3,579,867 | * | 5/1971 | Kuhn | 434/117 |
| 3,633,286 | * | 1/1972 | Maurer | 434/87 |
| 4,043,477 | * | 8/1977 | Deese | 402/79 |
| 4,179,138 | * | 12/1979 | Bogdanovic | 281/44 |
| 4,245,401 | * | 1/1981 | Riehle | 434/430 |
| 4,256,411 | * | 3/1981 | Podosek | 402/73 |
| 4,563,154 | * | 1/1986 | Vandervort | 434/87 |
| 4,572,380 | * | 2/1986 | Langwell | 211/57.1 |
| 4,746,123 | * | 5/1988 | Skirvin | 273/153 R |
| 4,795,081 | * | 1/1989 | Miller | 229/129 |
| 4,968,258 | * | 11/1990 | Kees | 434/370 |
| 5,110,295 | * | 5/1992 | Concra | 434/88 |
| 5,178,542 | * | 1/1993 | Chigrinsky | 434/157 |
| 5,441,418 | * | 8/1995 | Brown | 434/85 |
| 5,533,900 | * | 7/1996 | Volk | 434/87 |
| 5,599,189 | * | 2/1997 | Kees | 434/370 |
| 5,915,873 | * | 6/1999 | Karlis | 402/79 |

* cited by examiner

*Primary Examiner*—Jacob K. Ackun, Jr.
*Assistant Examiner*—Kurt Fernstrom
(74) *Attorney, Agent, or Firm*—Bradley P. Sylvester

(57) ABSTRACT

An improved reusable writing tablet, having raised document guides that define a document support surface, and a method for affixing and removing a cover sheet over the document support surface, where said document guides define a means to allow the insertion of tabs defined by a cover sheet, so that a cover sheet is held securely in place, and is easily removable from the base to allow the placement of documents between said cover sheet and the document support surface, and where said documents are viewed through the cover sheet, and are prevented from sideways movement by the cover sheet and raised document guides.

12 Claims, 11 Drawing Sheets

REUSABLE WRITING TABLE

BACKGROUND OF THE INVENTION

Typical writing tablets preferably provide a flat base surface upon which papers or other items may be laid and written upon. Writing tablets generally have the capability of being portable. In educational formats, writing tablets that have the capability of allowing interactive study with standard documents allow students an opportunity to learn without any significant degradation to the instructional documents.

Standardized paper sheets, forms, templates, or checklists are often intended for use as a temporary document, upon which marks or other notations allow an individualized response to a standard formatted work sheet. The worksheets provide a uniform level of instruction, with which a plurality of students can each use the same work sheet in their respective studies.

Prior attempts at incorporating standard work sheets to teach an individualized group of students have generally used separate answer sheets to provide an area for written responses to standardized questions. Upon completion of the activity, the marked answer sheet is often discarded, and a new sheet or form is used when the activity is again performed. Optimally, some type of writing surface, separate from the standardized work sheet is provided, having the ability to sustain multiple erasures.

Educational examples include various school room activities such as arithmetic practice sheets and tests, writing and art exercises in which letters or shapes are traced, fill-in-the-blank exercises, and many others. Educational needs are not the sole recipients of this type of invention. Examples include household grocery lists, miscellaneous lists, and work status sheets in the manufacturing and service industries.

An invention which holds the standardized master sheet, and allows the necessary written information to be recorded in close juxtaposition to the master sheet, which can be later removed, without actually contacting the master sheet or degrading it in any way, has many benefits. For example, a master sheet containing mathematical problems can be worked on and given an answer by a student using this invention. The student is able to write down the answers and show the method for arriving at the answers on a transparent or translucent cover sheet which covers the master sheet. The student may then check his answers by removing the master sheet, turning it over, and re-inserting it behind the cover sheet. The answers to the problems, which are printed on the back side of the master sheet, are then displayed. The answers or other markings which the student has placed on the cover sheet are then erased. The student may then either work the same exercise again, or remove it and replace it with a different master sheet.

Prior inventions have sought to create a learning aid which was capable of using a standardized sheet with an integrated answer sheet. Such an example is found in U.S. Pat. No. 4,968,256 (Kees), in which a learning aid permitted a student to insert the worksheet into the rigid body of the invention which defined a space between two planes. The top plane was clear and allowed markings to be made on it, above the worksheet which was positioned below the top plane. This particular invention required multiple supported sheets of material, and the transport and storage of such could prove to be rather cumbersome. The invention presently disclosed uses a single rigid surface and one flexible overlay. No static electricity is required, and worksheets are laid into the present invention, not fed into it.

Another variation on this type of invention is shown in U.S. Pat. No. 5,110,295 (Concra). This invention was disclosed as an educational training device in which a plurality of transparent sheets and a base sheet were secured in a fixed registry on the top surface of the frame. This allowed the person to trace or draw on a transparent sheet situated above the underlying master sheet. The drawback to this invention was that the support means, used to position the top transparent sheet, were basically utilized through a series of holes or perforations, and although this invention would allow multiple sheets to add different characteristics to maps and the like, the bottom edge of the top sheet would easily move sideways if force were applied. While this invention would work well with maps, it has sufficient drawbacks, and it would not be suitable for use when the master sheet has, for example, a depicted set of math problems, with a top transparent sheet covering the sheet upon which the student would write their answers to the problems.

An attempt to improve the function of a transparent writing surface with the use of a master sheet of educational problems, is shown in U.S. Pat. No. 5,409,383 (Mannino). This invention had a framework enclosure which had the ability to hold or position a top transparency sheet over a master sheet of problems or other miscellaneous printed items. One of the drawbacks to this invention was the substantial size of the frame which supported the master sheet and top transparency sheet. Although the transparency sheet would be securely held in position, the entire framework had to be lifted up from the rest of the apparatus, in order to remove or reposition the transparency. In this format, this invention was basically comprised of a rigid top transparent lid which, when closed over a writing surface, would position or allow the document on the right surface to be held in place, while other markings could be made directly to the transparent sheet. Although the invention appears to properly disclose the fact that the top transparent sheet is easily erasable, the removal of the actual transparent sheet itself could be rather burdensome.

A further attempt to make a more productive and user friendly apparatus is shown in U.S. Pat. No. 5,599,189 (Kees). This invention is an improvement over that shown in U.S. Pat. No. 4,968,258 and is by the same inventor. In this invention, a clipboard was actually inserted between the upper and lower piece, and the master sheet or worksheet was placed on clipboard. Writing and other notations were placed directly on the upper or top piece. This invention clearly provided a simple means to insert and use a master sheet with the student able to provide answers in an erasable format on the transparent covering. The drawback to this invention is that there are two separate rigid pieces that had to be combined in order to work together. Manufacturing this invention would appear to require an extrusion method, with other types of machining and molding done as well. This invention, as its predecessors, continues to have a rather bulky format, which proves cumbersome, especially to young students who are the intended users, and who must often transport the apparatus.

Attempts have been made to provide an invention that can securely hold sheets of plastic in position on or above a writing surface. An example of such an attempt is shown in U.S. Pat. No. 5,533,900 (Volk), in which a series of covering tabs are provided to hold a stencil sheet in place for purposes of tracing on a paper below. While this invention does provide a reasonable means to hold a transparent sheet in position, the protruding tabs infringe on the available writing surface, and may easily interfere with efforts of writing or making marks on the transparent sheet, through physical contact with the writer's hand, as well as lessening the available surface area which to make marks upon.

SUMMARY OF THE INVENTION

This invention is comprised of two interrelated pieces that are easily manufactured, which are lightweight, and when combined, provide a writing tablet with a suitable writing surface having a minimal thickness.

A base is provided in which a smooth surface is defined, having dimensions that approximate the size of a master sheet of paper that can be placed upon the smooth surface of the base. The base itself has a minimal height, whose sides are at least slightly greater than the intended master sheet which is placed upon the smooth surface. These raised edges frame an area in which the master sheet is fixed in position in relation to the base.

A top transparent or translucent cover sheet is provided, in which the cover has a size which allows it to fit upon the smooth writing surface area of the base, with its top and bottom edges and side edges able to be contained within the raised side edges of the base. The cover sheet is preferably of the type that allows written material to be viewed through it, so that when the cover sheet is placed over a master sheet having written or graphic design material imprinted thereon, a person will be able to view the master sheet without any significant diminution of the visual matter on the master sheet. The cover sheet is also comprised of a material that is adaptable to receiving marks and notations from various types of writing instruments, which also allows the marks to be removed when desired.

One of the benefits of this invention is that the cover sheet maximizes the available writing surface. The means to hold the cover sheet in position over the base is provided by tabs which fit into receiving areas defined by the base.

When a document is placed between the cover sheet and base, with the cover fastened down over the document, neither the cover or the document will move in relation to each other. Any work done on the cover sheet will be able to be used with this or with any other master sheet that is intended for subsequent use. For example, where a master sheet having math problems on it requests that the user provide answers on the cover sheet, it can be replaced with a master sheet that has the math problems and answers imprinted thereon, so that the user can easily check their answers on the cover sheet with those on the new master document.

The base may be provided with defined areas which allow easy placement of the cover on the base, as well as easy removal. A person's finger may be used to lift a tab of the cover sheet away from the base. The cover sheet may also be provided with a means to more firmly fasten it into position through the slots on the base, by also defining an aperture through which a raised protrusion on the base is able to insert through a tab.

Accordingly, it is an object of this invention to provide an improved base and cover sheet, in which a master sheet can be inserted between the cover sheet and base, where the base is particularly adapted to receiving protruding tabs defined by the cover sheet.

It is a further object of this invention to provide a writing surface that is not affected or diminished by any means in which the cover sheet is positioned over a master sheet.

It is a further object of this invention to provide the cover sheet which can be positioned over the smooth surface of the base in which tabs are able to fit into securing areas defined by the base, with said tabs able to be inserted therein, as well as removed with minimal effort, so as to either remove or insert a master sheet.

It is a further object of his invention to provide a writing surface which comprises a base that is able to hold and position a master sheet, in which said base has a minimal thickness, so that the user of this invention is able to make markings on a cover sheet without interference by any raised areas of the base, thereby maximizing the user's comfort and ease of writing, and minimizing the user's fatigue, while the user marks on the cover sheet.

DETAILED DESCRIPTION OF THE INVENTION

Figure 1:
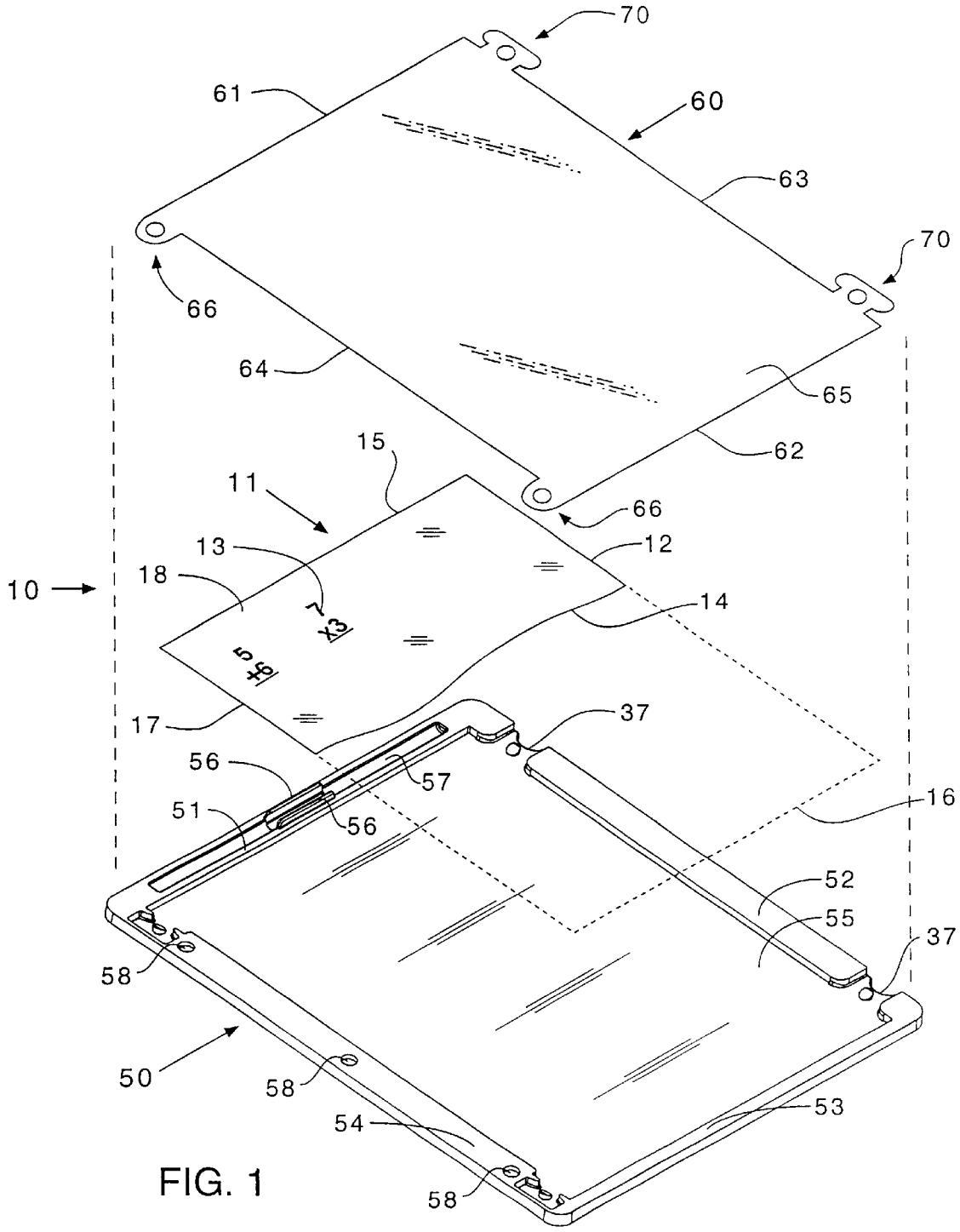
FIG. 1 is an exploded perspective view of the upper side of the base and cover sheet, with a document positioned between said cover sheet and base.

Referring now to FIG. 1 the improved reusable writing tablet 10 is shown, being comprised of a base 50, and a cover sheet 60. The cover sheet 60 is able to be lifted away from the base 50 so as to allow the insertion of a document 11 in between said cover sheet 60 and base 50.

Figure 13:
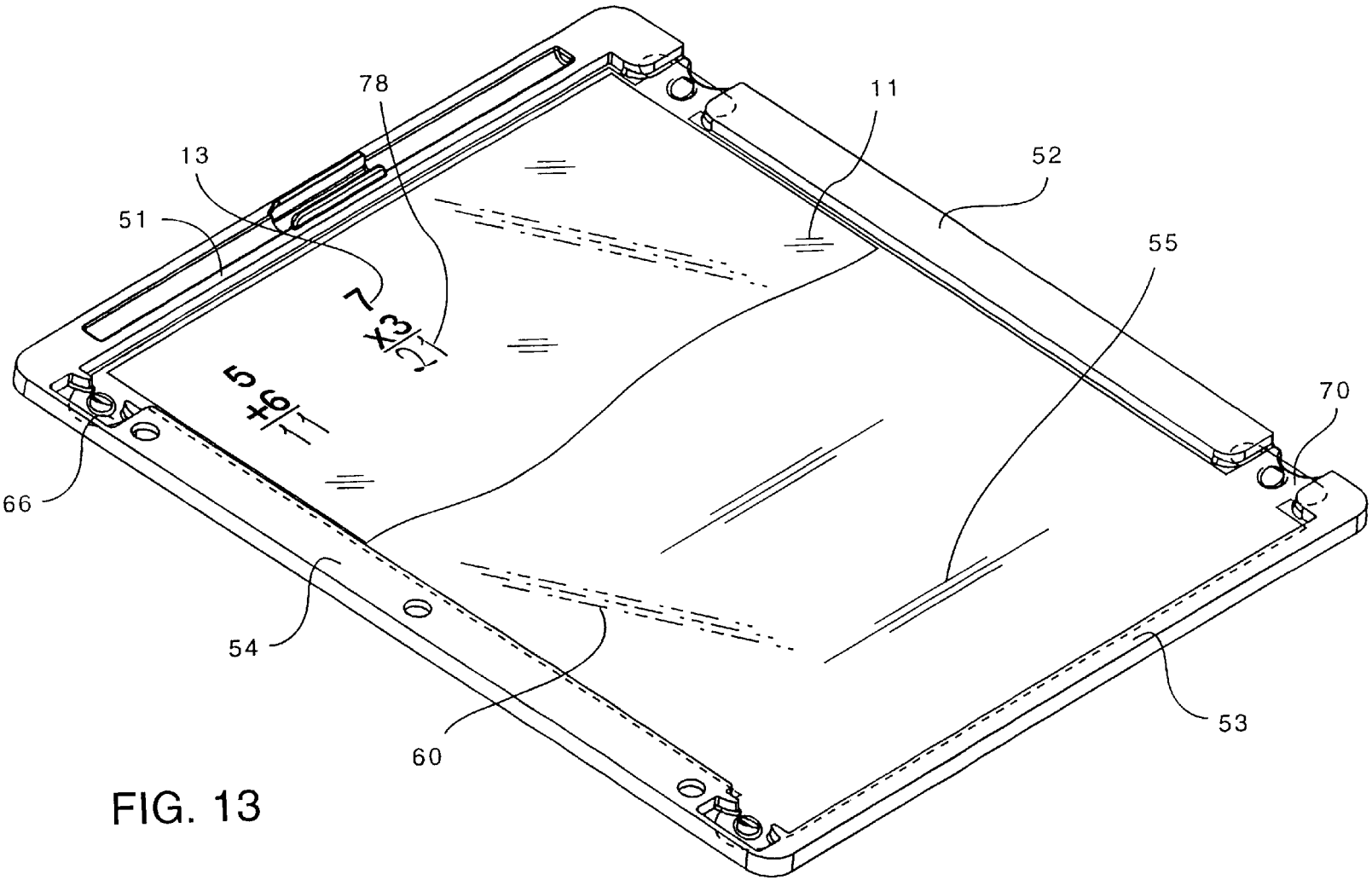
FIG. 13 is a top perspective view of the reusable writing tablet with the cover sheet's detachable tabs shown fully inserted into the detachable tab holder area, with answers depicted as having been written on the cover sheet.
Figure 14:
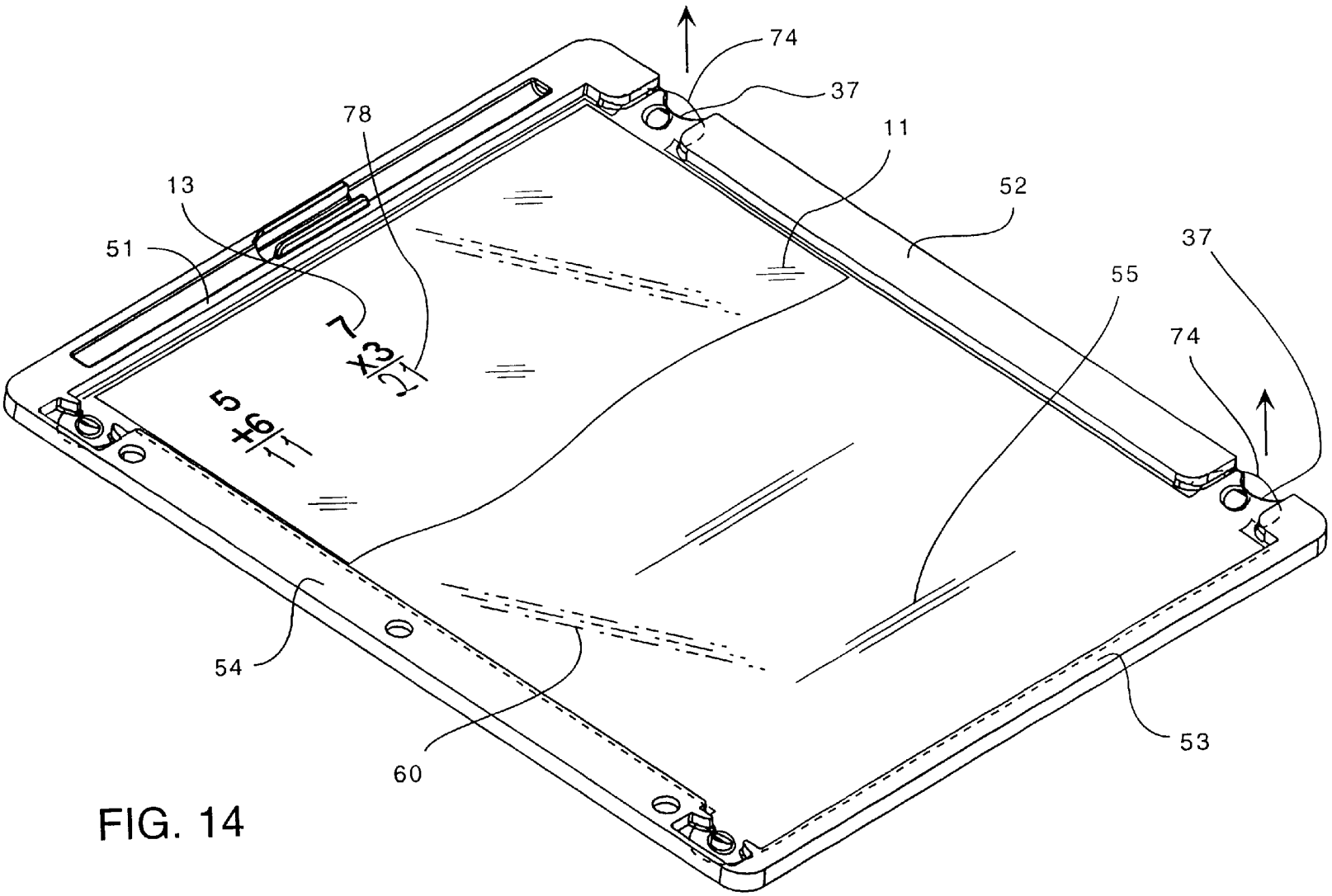
FIG. 14 is a top perspective view of the reusable writing tablet with the cover sheet's detachable tabs shown being lifted up out of the detachable tab holder area, as the first step to gain access to the document.
Figure 15:
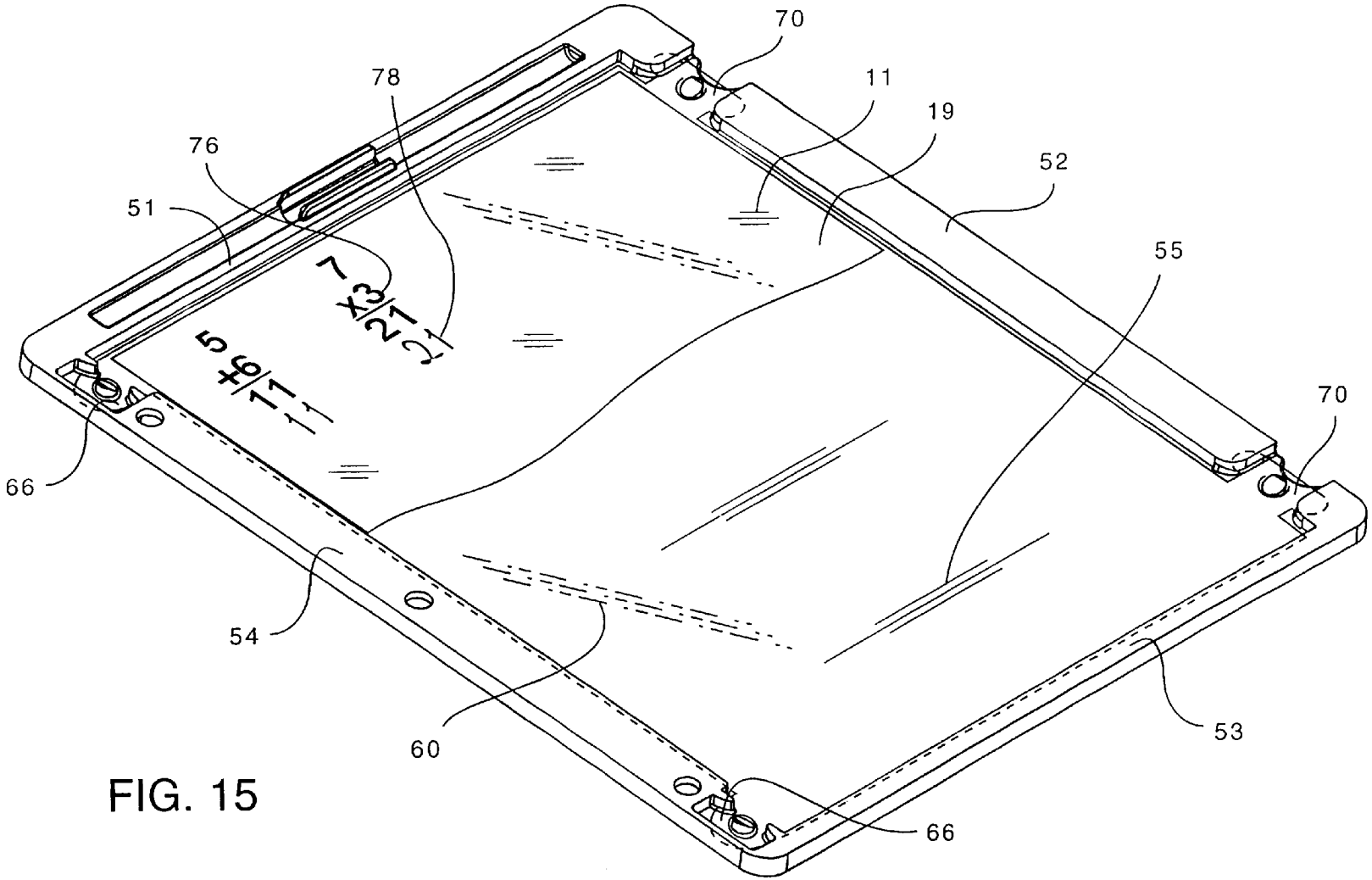
FIG. 15 is a top perspective view of the reusable writing tablet with an answer document which shows the answers to the problems, for comparison with the answers written on the cover sheet.

The cover 60 is comprised of a sheet of material that is capable of allowing light to pass through it without appreciable distortion. Typically, the cover 60 will be constructed of optically clear, or translucent plastic. The cover 60 is preferably constructed of a material that is capable of being flexed without permanent damage, as it is typically available in many types of plastic sheeting material. When flexed, it will apply a resistant force that will return it to its original flat sheet configuration when the force causing the flex is removed. Cover 60 preferably has the ability to have marks made upon it, with said marks able to be removed or erased as needed. An example of such marks is shown as a student answer 78, as shown in FIGS. 13, 14 and 15.

Cover 60 is defined by a top side edge 61, a bottom side edge 62, a detachable side edge 63 and a fixed side edge 64, so as to generally define a rectangularly shaped sheet. The dimensions of side edges 61,62,63 and 64 should approximate the dimensions of the document support surface 55 defined by base 50. It should be understood that the shape of the cover 60, as shown in FIG. 1, as a rectangular shaped sheet, should in no way be construed as a limitation on the available shapes and configurations of cover 60. The shape and dimensions of cover 60 preferably closely match the base's raised peripheral edges 51, 52, 53 and 54 that define the available surface area of the document support surface 55, regardless of the shape and defining peripheral edge of the document support surface 55. In this manner, if the document support surface 55 is defined as a square-shaped area, the cover 60 will also have its peripheral edges 61,62, 63 and 64 likewise define a square-shaped sheet having substantially the same surface area and dimensions as surface 55. Where base 50 defines a document support surface 55 that has a circular peripheral edge, the cover 60 would likewise define a circular peripheral sheet having similar dimensions and size.

It should be understood that this invention is capable of being used for a variety of purposes, such as labels, advertising signage, and other document holders of different sizes. The configuration shown in FIG. 1 is that which would find optimal use with documents 11 generally comprised of paper having outer dimensions of 8.5 inches by 11 inches. One of the intended uses of this invention is for educational purposes, involving standardized documents that may be used with this invention for various learning procedures. As such, a typical embodiment of this invention will be to use a document 11 of a standard size of 8.5 by 11 inches.

Cover 60 has at least one detachable tab 70, and at least one fixed tab 66. The cover 60, shown in FIG. 1, defines a detachable tab 70 that protrudes peripherally outward from the detachable side edge 63, and is located along the edge 63 near the point where it meets the top side edge 61. A second detachable tab 70 protrudes peripherally outward from the detachable side edge 63 near the bottom side edge 62. Where the cover 60 and document support surface have larger dimensions, additional detachable tabs 70 may be necessary, and protrude peripherally outward along the detachable side edge 63 or multiple edges when other configurations are used.

Figure 7:
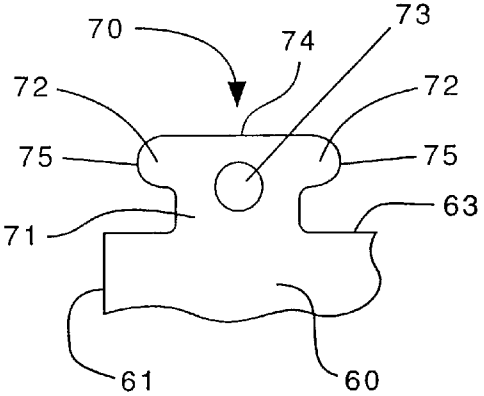
FIG. 7 is a top view of the cover sheet's detachable tab.

Referring now to FIG. 7, an enlarged view of the detachable tab 70 is shown, protruding outward from the detachable side edge 63. The detachable tab 70 is defined by a protruding neck 71 that supports a pair of opposably flared flaps 72 which are defined by flap edges 75, the neck 71 and the detachable tab edge 74. The detachable tab 70 may define an 73, which is preferably defined in the central portion of the detachable tab 70, with said opening 73 generally defined in the neck 71 area.

Referring again to FIG. 1, cover 60 has at least one fixed tab 66. The cover 60 shown in FIG. 1 defines a fixed tab 66 that protrudes peripherally outward from the fixed side edge 64 near the top side edge 61. A second fixed tab 66 protrudes peripherally outward from the fixed side edge 64 near the bottom side edge 62. Where the cover 60 and document support surface 55 have larger dimensions, additional fixed tabs 66 may be necessary, and will likewise protrude peripherally outward from the fixed side edge 63 or multiple edges when other configurations are used.

Figure 4:
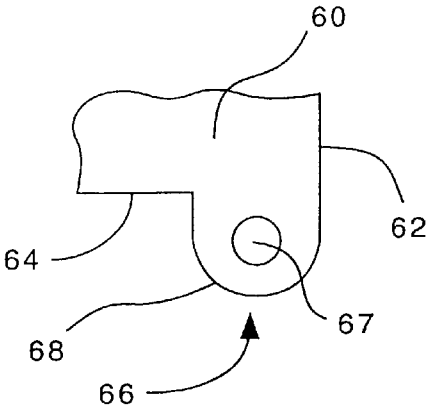
FIG. 4 is a top partial view of the cover sheet, depicting a fixed tab.

Referring now to FIG. 4, which depicts a closer view of the fixed tab 66. Fixed tab 66 protrudes outward from the fixed side edge 64, and is defined by edge 68 that partially encircles a centrally defined opening 67.

Although tabs 70 and 66 are shown as extensions outward from the detachable side edge 63 and fixed side edge 64, this should in no way be construed as a limitation on the possible locations of either the detachable tabs 70 or the fixed tabs 66. Tabs 70 and 66 are used to affix the cover 60 over the document support surface 55. In some instances, detachable tabs 70 or fixed tabs 66 may protrude outward from the top side edge 61 or bottom side edge 62, when it is desired for the cover 60 to be held in place through tabs 66 and 70 that are defined at the top and bottom edges of said cover 60.

Referring again to FIG. 1, the base 50 is comprised of a rigid material that is particularly adapted to receiving cover 60. Base 50 defines a document support surface 55 which has a defined surface area that is framed in by raised document guide edges. The document guide edges are comprised of raised projections which preferably frame the document support surface 55 in dimensions that are substantially equivalent to the peripheral edges of the cover 60. As discussed above, the cover 60 should not be limited to a rectangular shape as shown in FIG. 1, but that the scope of this invention is intended to include a plurality of possible shapes for said cover 60. The document support surface 55 may be defined in any shape desired, as defined by raised side edges. Raised side edge guides may define the edge of the document support surface 55 in a curved or straight line, and the number of raised side edge guides may vary according to the desired shape and configuration of the document support surface 55 and cover 60.

As is shown in FIG. 1, the document support surface 55 is defined by a raised top edge document guide 51, a raised right edge document guide 52, a raised bottom edge document guide 53, and a raised left edge document guide 54, which define the peripheral edge of the document support surface 55 in a generally rectangular shape. As is shown in FIG. 1, each raised side edge 51, 52, 53 and 54 has a height that it is slightly greater than the thickness of cover 60. These raised side edges 51, 52, 53 and 54 serve to not only defined a surface area which the cover 60 is laid upon, but said side edges 51, 52, 53 and 54 provide a barrier wall which prevents sideways movement of a document 11 when said document 11 is placed on the document support surface 55. Preferably, the document 11 will have a peripheral edge having a similar shape and dimensions as the document support surface 55.

Document 11, as shown in FIG. 1, is intended to portray a typical sheet of paper, having dimensions of 8.5 by 11 inches. As a shown in FIG. 1, document 11 has a front surface 18 that has an area defined by a document top edge 15, the document right side edge 12, the document left side edge 17, and a document bottom edge 16. For purposes of clarity, document 11 in FIG. 1 depicts a cut-away view as shown by cut-away edge 14, which allows an unobstructed view of base 50. A sample problem 13 is shown as imprinted on the front surface 18 of document 11.

Figure 2:
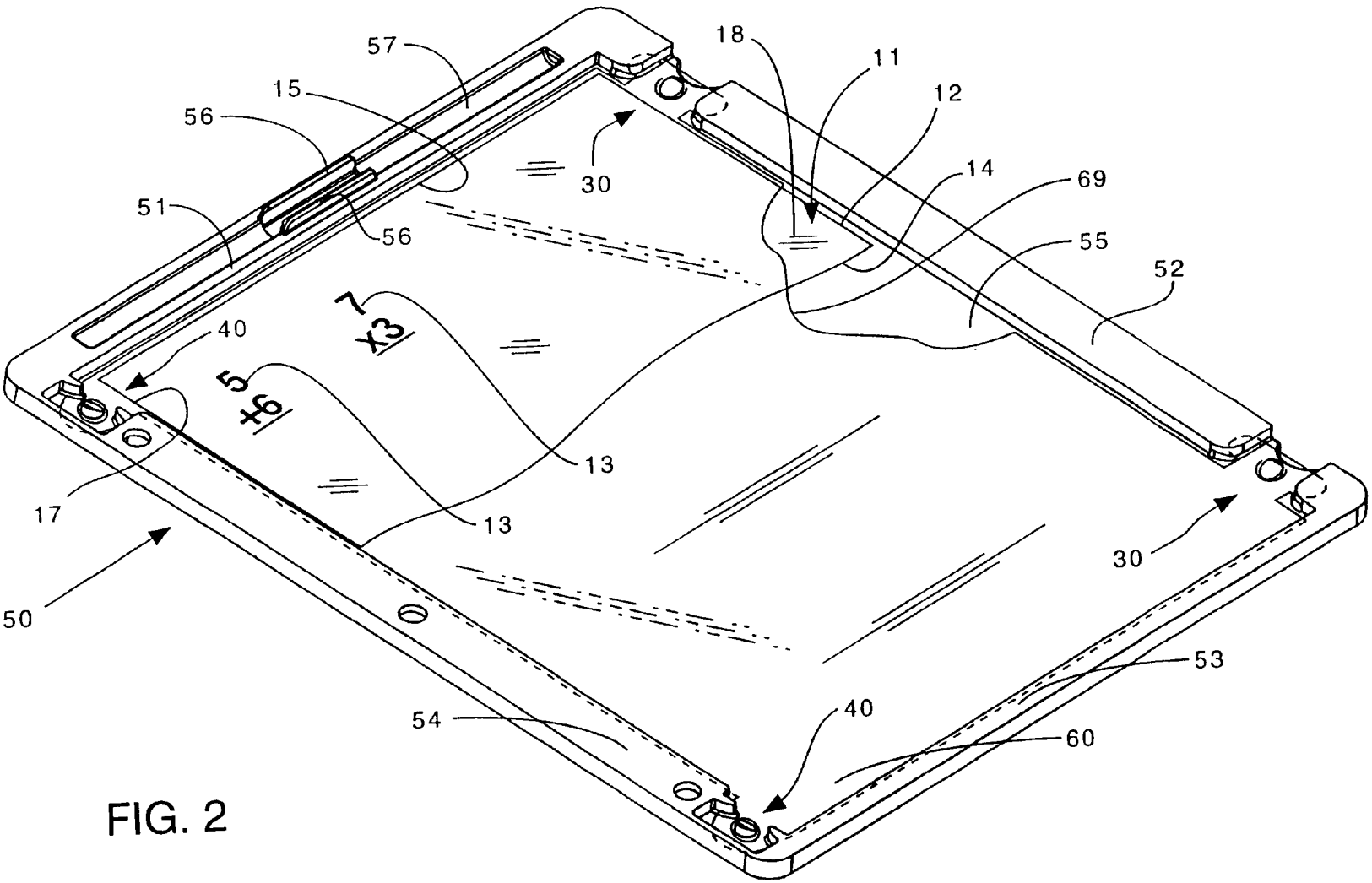
FIG. 2 is a perspective view of the improved reusable writing tablet and a document shown positioned between the base and cover sheet.

Referring now to FIG. 2, document 11 is shown situated on the document support surface 55. Sample problems 13 are shown imprinted on the front side 18 of document 11. As is shown, the document right side edge 12 is positioned adjacent to the raised right edge document guide 52. The document top edge 15 positioned adjacent to the raised top edge document guide 51. The document left side edge 17 is positioned adjacent to the raised left edge document guide 54. The document bottom edge 16, as shown in FIG. 1, would be positioned adjacent to the raised bottom edge document guide 53. For purposes of clarity, document 11 is shown with a cut away edge 14.

As is shown in FIG. 2, the document 11 will be unable to slide sideways in any direction, due to the restrictive barrier provided by raised document guide edges 51, 52, 53 and 54. Even if the cut away edge 14 of document 11 functioned as the bottom edge 16, document 11 would still be prevented from sliding movement in all directions but toward the raised bottom edge document guide 53.

As is also shown in FIG. 2, cover 60 has been placed over document 11, with the cover 60 and document 11 being positioned over the document support surface 55. The cover 60 is additionally secured in position through tabs 66 and 70, which will be discussed more fully below. The base 50 provides additional conveniences, such as holes 58 which are defined at various points along the raised left edge document guide 54, and are spaced apart so as to be able to receive the typical prongs that are present in three-ring binder notebooks. Thus this improved reusable writing tablet 10 is capable of being carried in a typical three-ring notebook. The overall height of the base 50 is typically no more than one fourth to one half inch. The overall height of the raised edge document guides 51, 52, 53 and 54 that is raised above the document support surface 55 is typically one eighth to three eighths inches. This allows multiple documents 11 and a cover 60 to concurrently be held in place on the document support surface 55.

The base 50 is also provided with a writing instrument holding groove 57 and a pair of opposably situated prongs 56 which are spaced apart and capable of gripping the sides of a writing instrument when it is placed into the writing instrument holding groove 57. Prongs 56 may have a resilient flex, so as to grip writing instruments of various circumferences. Said writing instrument holding groove 57 is defined as a linear groove across a portion of the length of the raised top edge document guide 51.

Figure 6:
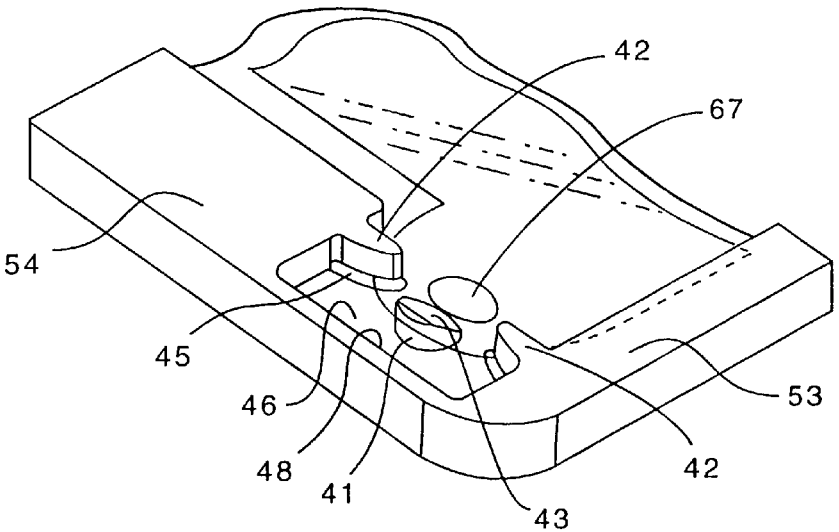
FIG. 6 is a perspective view of the fixed tab holder area and a portion of the base with the cover sheet's fixed tabs partially placed into the fixed tab holder area.
Figure 5:
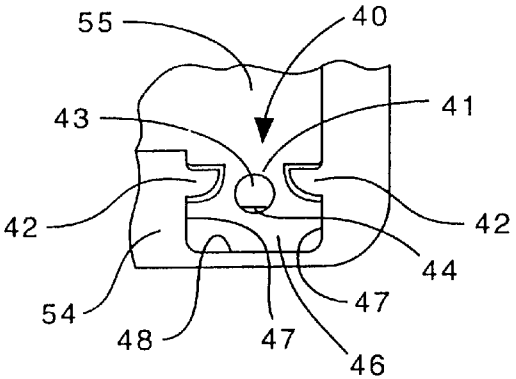
FIG. 5 is a top view of the fixed tab holder area.

Referring now to FIGS. 4, 5 and 6, a means to attach the cover 60 to the base 50 is shown. Fixed tab 66, is placed into the fixed tab holder area 40, which is shown in enlarged detail in FIG. 5 and FIG. 6. As it is shown in FIG. 1,the tab holder area 40 is defined along the raised left edge document guide 54. As is shown more clearly in FIG. 5, the fixed tab holder area 40 is comprised of a recessed area defined by fixed tab holder side walls 47 which are spaced apart so as to accommodate the width of the fixed tab 66, and a fixed tab holder back wall 48 which is recessed into the width of the raised left edge document guide 54 so as to allow the entire fixed tab 66 to be placed into the fixed tab holder area 40. A pair of opposably positioned retaining tabs 42 protrude toward each other from each fixed tab holder side wall 47 to create a narrower opening into the fixed tab holder area 40. As is shown more clearly in FIG. 6, each retaining tab 42 defines a gap 45 between the underside of retaining tab 42 and the fixed tab support surface 46 which the fixed tab 66 lays upon. The gap 45 has a sufficient width so as to allow the fixed tab 66 to move through it toward the fixed tab holder back wall 48, so that when the fixed tab 66 is positioned in the fixed tab holder area 40, it is restrained from any upward lifting movement.

The retaining post 41 protrudes directly upward from the fixed tab support surface 46, and has an angled top surface 43 that increases the height of the retaining post 41 toward the fixed tab holder back wall 48. Retaining post 41 may also have a flat top surface 44 on the top side adjacent to the fixed tab holder back wall 48.

Figure 10:
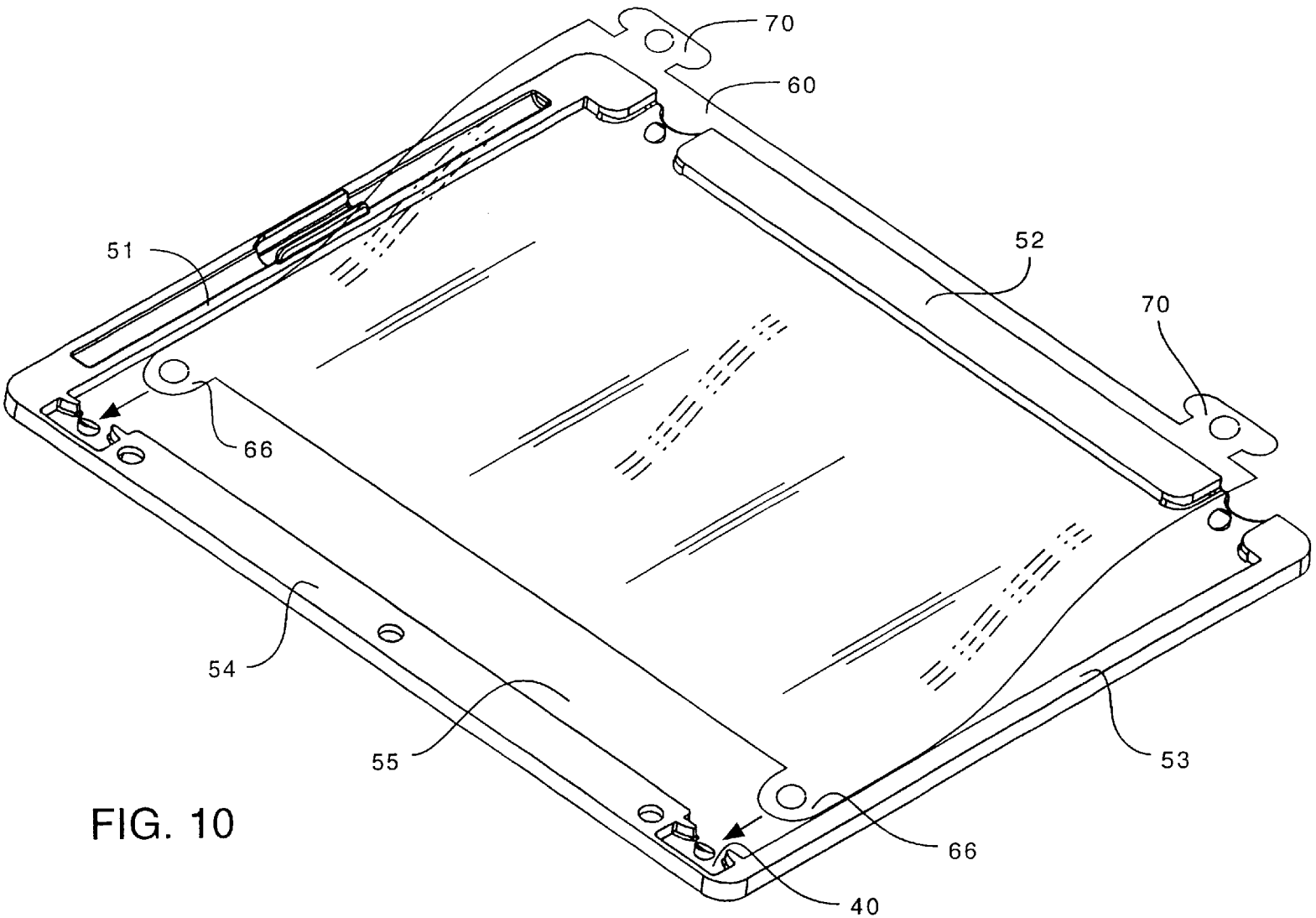
FIG. 10 is a top perspective view of the reusable writing tablet with the cover sheet being positioned for attachment to the base by insertion of the fixed tabs into the fixed tab holder area.

To attach cover 60 to base 50 using the fixed tabs 66, cover 60 is positioned above the document support surface 55 as shown in FIG. 10. The fixed tabs 66 are slid along the document support surface 55 toward the fixed tab holder area 40, so that the leading edge 68 of the fixed tabs 66 moves underneath the retaining tabs 42 through the gaps 45, as shown in FIG. 6.

The curved edge 68 will contact the angled top surface 43 of the retaining post 41, and as the fixed tab 66 is urged toward the fixed tab holder back wall 48, the central portion of the curved edge 68 of the fixed tab 66 will be forced upward as it moves over the retaining post 41. This will cause the entire fixed tab 66 to arch upward, as the portion of the tab 66 underneath the retaining tabs 42 remains against the fixed tab support surface area 46.

As the fixed tabs 66 reaches a desired curvature arch, it will continue to move past the flat top surface 44 of the retaining post 41. As the edges of the circular opening 67 move around the retaining post 41, with the fixed tab 66 being positioned so that the retaining post 41 can move through the circular opening 67, the downward resilient force applied by the fixed tab 66 as it tries to flatten out, will force the tab 66 down over the retaining post 41, so that the retaining post 41 protrudes fully through said circular opening 67. The flat top surface 44 provides a less severely angled edge on the retaining post which the circular opening 67 edge must move past, and allows the retaining post 41 to move into the circular opening 67 more easily. In addition, the flat top surface 44 removes any abrupt edges that might cause discomfort to a person's wrist or forearm while placing marks on the cover sheet 60.

When the fixed tab 66 has been fully inserted into the fixed tab holder area 40, it will lay flat against the fixed tab support surface 46, being prevented from sideways movement by the retaining post 41, and from upward lifting force by the retaining tabs 42.

Figure 11:
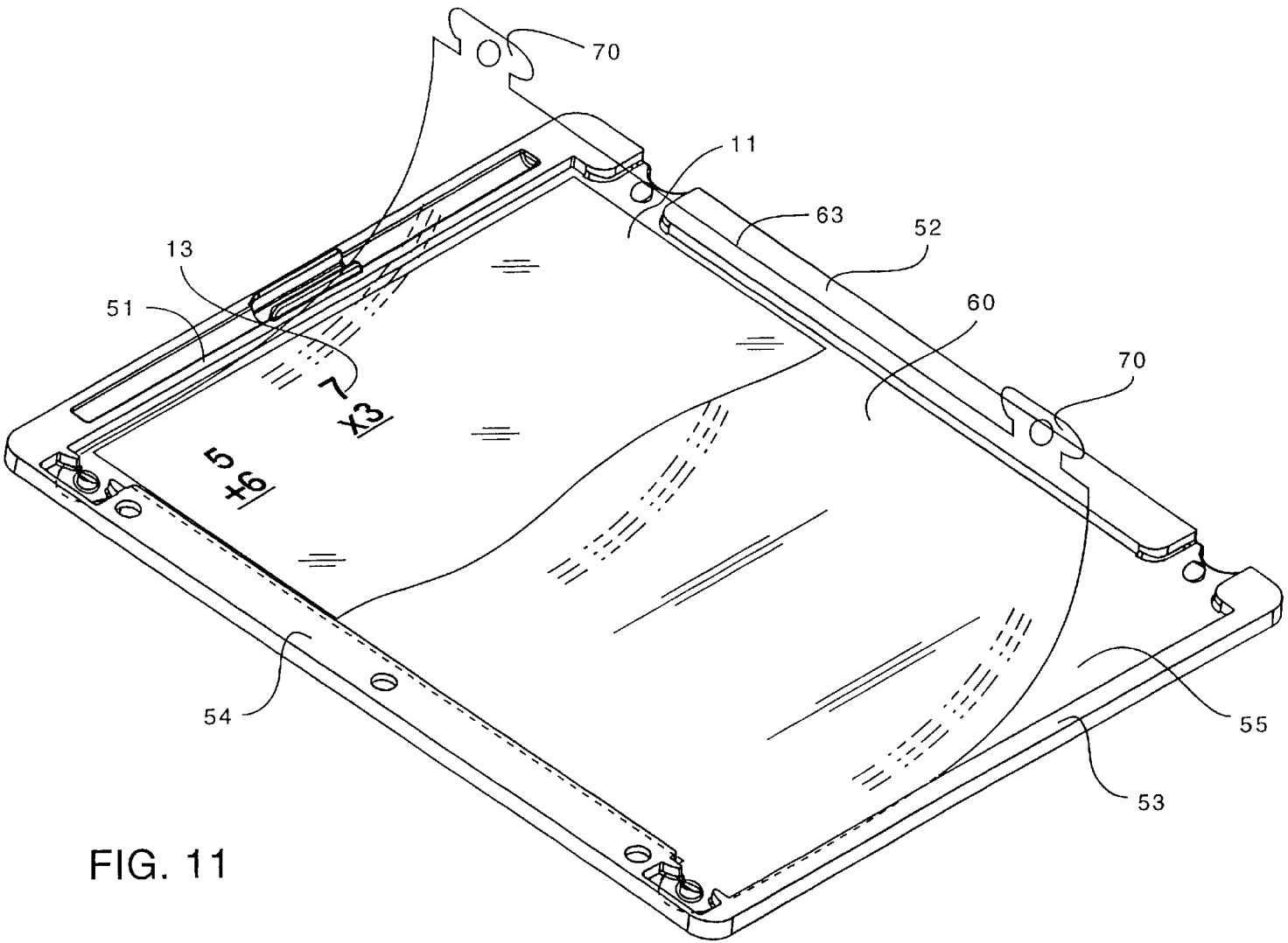
FIG. 11 is a top perspective view of the reusable writing tablet with the cover sheet's fixed tabs positioned in the fixed tab holder area, with a document placed between the cover sheet and base, and the cover sheet's detachable tabs positioned above the detachable tab holder area.

Although the fixed tabs 66 may be removed from the fixed tab holder area 40, to do so requires more than inadvertent manipulation. Thus, one side of the cover 60 will be held in position with regard to the base 50. As is shown in FIG. 11, when one side of the cover 60 is fixed to the base 50, the cover 60 may still be lifted up on one side, to allow access to the document support surface 55, and for the insertion or removal of documents 11.

Referring now to FIG. 7, a detachable tab 70 is shown, in which said tab 70 comprises an extension that protrudes outward from the detachable side edge 63 of the cover 60. The detachable tab 70 has a neck 71 that separates two opposable flaps 72. Flaps 72 are defined by a flap edge 75. Preferably, the neck 71 also defines a opening 73, similar to the opening 67 as shown in fixed flap 66.

Figure 8:
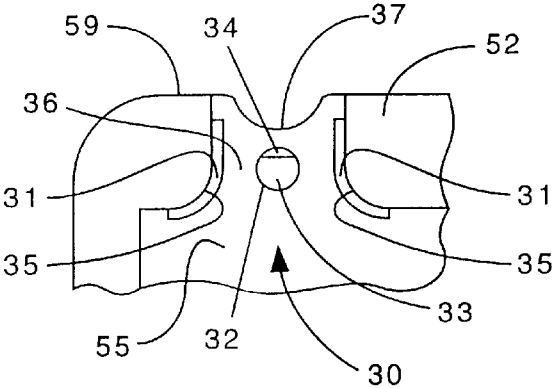
FIG. 8 is a top view of a portion of the base showing the detachable tab holder area.

Referring now to FIG. 8, the detachable tab holder area 30 is shown, defined as a gap in the raised right edge document guide 52. As is shown in FIG. 1, the detachable tab holder area 30 is defined as a gap along the length of the raised right edge document guide 52 near the junction between the right raised edge document guide 52 and the raised top edge document guide 51, and also near the junction between the raised right edge document guide 52 and the raised bottom edge document guide 53. A tab detachment finger notch 37 defines the extended limits of the document support surface 55 through the detachable tab holder area 30. This tab detachment finger notch 37 is preferably a curved concave edge that would accommodate a portion of the circumference of a person's finger.

Figure 9:
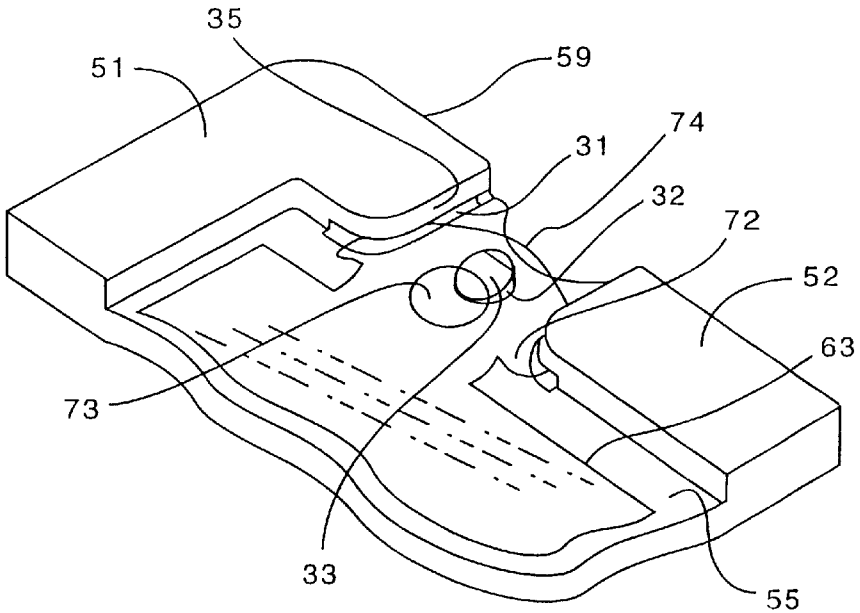
FIG. 9 is a perspective view of the detachable tab holder area with the cover sheet's detachable tabs partially placed into the detachable tab holder area.

Referring also to FIG. 9, the detachable tab holder area 30 provides a protruding extension of the document support surface 55, having a width defined by flap retaining edges 35 which are positioned so as to define a flap insertion slit 31 between the document support surface 55 and said flap retaining edge 35.

As is shown in FIG. 9, when the detachable tab 70 is laid on the document support surface 55 immediately adjacent to the detachable tab holder area 30, and then said detachable tab 70 is slid along the document support surface 55 into the detachable tab holder area 30, this action will cause the flaps 72 move into the flap insertion slits 31. As it is shown in FIG. 9, the width of the detachable tab 70 as measured from the edges 75 of each flap 72, to the opposing edge 75, must be greater than the distance between the flap insertion slits 31 in each detachable tab holder area 30. In this manner, when the detachable tab 70 is urged into the detachable tab holder area 30, both edges 75 of the flaps 72 will be inserted into the flap insertion slit 31 between the flap retaining edge 35 and document support surface 55.

As the detachable tab 70 is urged further into the detachable tab holder area 30, the detachable tab edge 74 will make contact with a retaining post 32 that protrudes upward from the document support surface 55 in the gap as defined between the flap retaining edges 35. As the detachable tab edge 74 is urged further into the detachable tab holder area 30, the detachable tab edge 74 will move upward along the angled top surface 33 of the post 32. As it is shown in FIG. 9, the width of the detachable tab 70 will arch upward so as to be able to pass over the retaining post 32, while at the same time having the distal ends of the flaps 72 remaining within the flap insertion slits 31. This arching will be resisted by the detachable flap 70 which will attempt to return to a straightened flat sheet configuration. As is shown in FIG. 13, once the detachable tab 70 has been urged fully into the detachable tab holder area 30, the opening 73, which has a greater perimeter than the retaining post 32, will move down around the outside of said retaining post 32 until the detachable tab 70 returns to its flat sheet configuration, and will be secured within the detachable tab holder area 30. The flap insertion slits 31 have a height that extends above the plane of the document support surface 55, so that be entire detachable tab 70 is able to rest against the document support surface 55 with its flaps 72 extending through the flap insertion slits 31 into cavities 77 as shown in FIG. 3.

Figure 3:
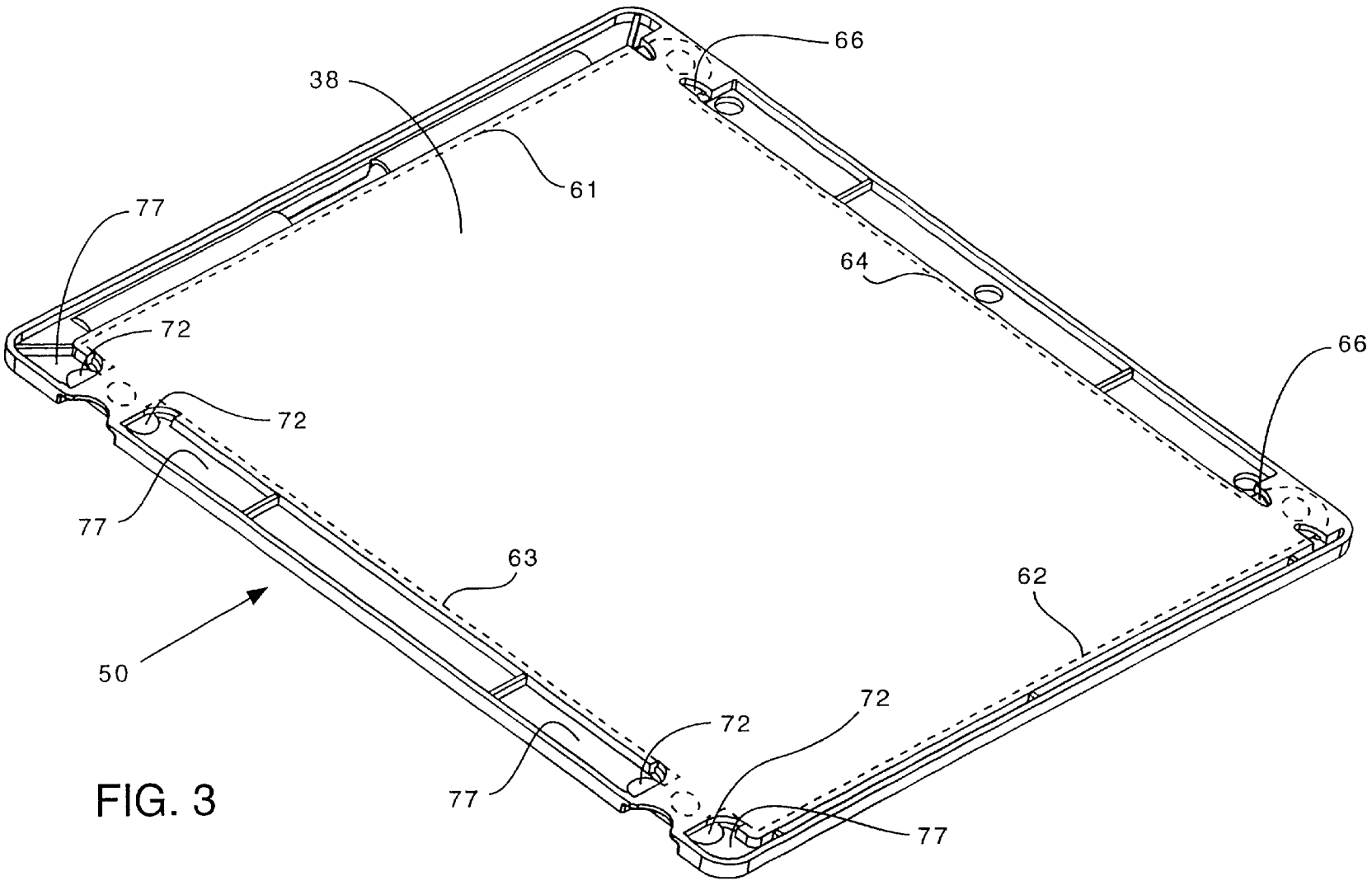
FIG. 3 is a perspective view of the lower underneath side of the base, in which the tabs of the cover sheet are shown protruding through the gaps defined by the base.

Referring also now to FIG. 1 and FIG. 3, the bottom side of base 50 is shown. A base underside 38 extends across the underneath side of the document support surface 55. As shown in FIG. 3 on the bottom side of base 50, adjacent to the fixed tab holder area 40 are cavities 77 that are defined by the underside of the respective document guides 51,52,53 and 54 as shown in FIG. 1. While not necessary as a space for the fixed tab 66 to move into, these cavities 77 provide a space into which the flaps 72 of the detachable tabs 70 can protrude into the flap insertion slits 31, and retain their flat sheet configuration. The flap insertion slits 31 may have sufficient depth so that the flaps 72 do not actually protrude into the cavities 77. If the flaps 72 do protrude into the cavities 77, then the extent of the cavities 77 is only required to accommodate the insertion of flaps 72, and the actual dimensions of the cavities 77 shown should not be construed as a limitation on the scope of this invention.

Since various persons may desire fixed tabs 66 and detachable tabs 70, to occupy document guides other than those specifically shown in these figures, it should be understood that the configuration of fixed tabs 66 and detachable tabs 70 shown in these figures are examples of one possible configuration. Any combination of detachable tabs 70 and fixed tabs 66 may be used. In addition, the retaining posts 32 and 41, may have any desired outer configuration and design, which would be able to move through what has been referred to as openings 67 and 73. It is not intended by the figures and references shown to limit the scope of this invention to circular shaped retaining posts 32 and 41 or circular shaped openings 67 and 73, as is shown in the figures. In addition, the geometric configurations shown for the fixed tab 66 and detachable tab 70, in the figures and references provided, should not be construed as an attempt to limit the available configurations for said tabs 66 and 70. All other possible configurations should be considered to be included within the scope of this invention.

Referring now to FIGS. 10–13, insertion of the cover 60 so that it is affixed to the base 50 and used with a document 11 is shown. To attach the cover 60, it is preferable to position the cover 60 on document support surface 55, so that the fixed tabs 66 are adjacent to their respective fixed tab holder areas 40, and then to slide the cover 60 and fixed tabs 66 toward the fixed tab holder areas 40. This operation is shown in FIG. 10.

Figure 12:
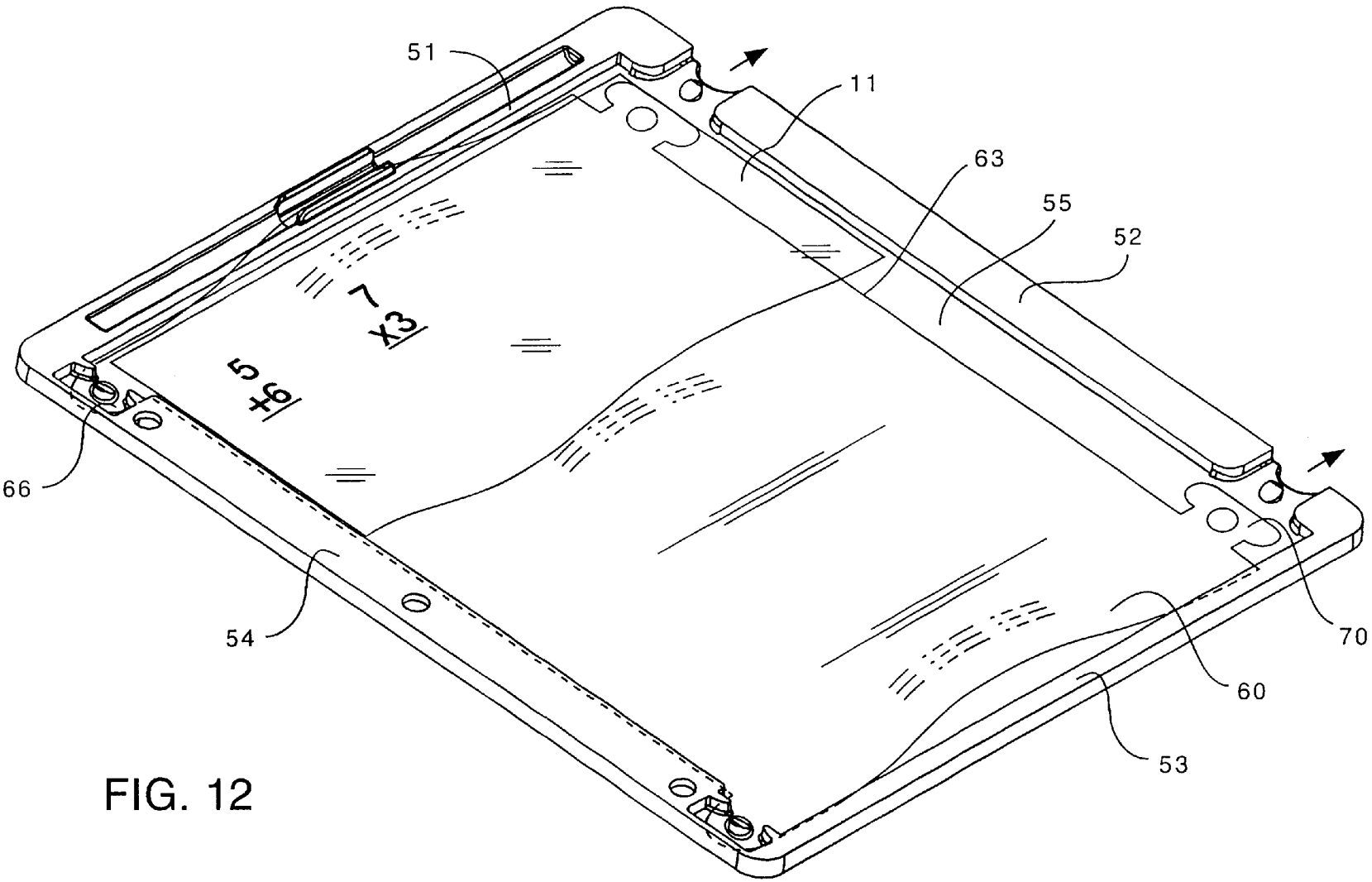
FIG. 12 is a top perspective view of the reusable writing tablet with the cover sheet's detachable tabs shown ready for insertion into the detachable tab holder area.

Once the fixed tabs 66 are secured within their holder areas 40, the cover 60 may be lifted up on the detachable side edge 63 so that a document 11 may be inserted into the area between the cover 60 and the document support surface 55. As a shown in FIG. 11, document 11 has an example mathematical problem 13 which is viewable through the cover 60. Once the document 11 is in its desired position, the detachable side edge 63 of cover 60 is laid in close proximity to the document 11 or document support surface 55, with the detachable side edge 63 being a distance from the right edge document guide 52, so that the entire detachable tab 70 is also in close proximity to the document 11 or the document support surface 55. The width of the cover 60 will tend to arch upward slightly when it is in this position as shown in FIG. 12.

To complete the attachment of cover 60 to base 50, the detachable tabs 70 are pushed into their respective tab holder areas 30 as shown in FIG. 13, so that the entire document 11 is protected by the cover 60. The example mathematical problem 13 is able to be viewed, with a proposed answer written on the top side of the cover 60. Friction caused by the person's hand or other object when using this invention should have little or no effect on the movement of the document 11, when so protected between the cover 60 and document support surface 55.

Removal of the document 11 is easily accomplished by lifting up the cover 60. This is accomplished as shown in FIG. 14. By contacting the detachable tabs 70 along their detachable tab edges 74, where that portion of the detachable tabs extends outward beyond the tab detachment finger notch 37, that portion of said tab 70 is urged up toward in the direction shown in FIG. 14. This causes the width of tab 70 to arch upward until the peripheral edges of the opening 73 are above the flat top surface 34 of the retaining post 32. The detachable tab 70 is then lifted upward until the tab flaps 72 are sufficiently flexed so as to slide along the tab retaining edges 35, and out of the detachable flap insertion slits 31. This allows the entire side of the cover 60 to be lifted up in the manner shown in FIG. 11. Alternatively, once the flap openings 73 are above the flat top surface 34 of the retaining post 43, the detachable tab 70 may be readily pushed horizontally out of the detachable holder area 30, so that the flaps 72 are pushed out of the flap insertion slits 31. Once again, this allows the entire side of the cover 60 to be lifted up in the manner shown in FIG. 11.

Another benefit of the ability of this invention to maintain position of the document 11, while it is protected by the cover 60 and document support surface 55, is as shown in FIG. 15. Here, the document 11 has been removed, and either turned over to display answers, or an answer sheet has been inserted therein in place of document 11. Where the document 11 is turned over, the front surface 18, having the problems without answers is replaced by revealing the back surface 19 of document 11 to show a slightly displaced problem with answer 76, which allows the given answer to be placed above the student answer 78 for simple comparison.

Since the cover 60 is not completely rigid, it can accommodate the placement of several documents 11 between it and the document support surface 55. This allows an entire series of lessons to be placed between the cover 60 and document support surface 55 at the same time. Where this invention is used for other purposes, such as sales tags or other advertising items, multiple documents 11 could likewise be stored for use.

From the foregoing statements, summary and description in accordance with the present invention, it is understood that the same are not limited thereto, but are susceptible to various changes and modifications as known to those skilled in the art and we therefore do not wish to be limited to the details shown and described herein, but intend to cover all such changes and modifications which would be encompassed by the scope of the appended claims.

I claim:

1. An improved reusable writing tablet capable of holding a document that is viewed through a detachable cover, comprising:

a. a base, having a plurality of document support guides that define a document support surface, where the height of the document support guides provide a barrier around the perimeter of the document support surface, which restrict sideways movement of a document placed on the document support surface;

b. a detachable flexible cover that defines a plurality of protruding tabs where said tabs define a central aperture through which a retaining post may be placed, and where said cover is placed on top of the document support surface, and fixed in position through the placement of the protruding tabs into tab holder means defined by the base, thereby defining an area between the cover and document support surface, into which a document may be inserted in said area so that the document rests on the document support surface and may be viewed through the cover;

c. a tab holder means, defined by the base, to affix the cover over the document support surface, where said tab holder means comprises a retaining post which projects upward from said base, so that when a protruding tab is positioned over the retaining post, the post is able to extend through the aperture defined in the protruding tab, so as to prevent any sideways movement of the detachable flexible cover in relation to the base.

2. An improved reusable writing tablet, as recited in claim one, in which the document edge guides define a generally rectangular document support surface having a height greater than the thickness of the detachable flexible cover.

3. An improved reusable writing tablet, as recited in claim one, in which the cover rests directly on top of the document support surface, and upon any document inserted between them, and where writing can be done directly on the detachable flexible cover.

4. An improved reusable writing tablet, as recited in claim one, in which the cover comprises a flexible flat sheet of material having tabs, where the sheet and any defined tabs share the same plane, and where the sheet and tabs resist any flexing force that causes said sheet and tabs to arch, and where the sheet and tabs will return to a flat planar configuration when the flexing force is removed.

5. An improved reusable writing tablet, as recited in claim one, in which the cover is defined by a top side edge, a bottom side edge, a detachable side edge, and a fixed side edge, which define a perimeter edge having a generally rectangular shape.

6. An improved reusable writing tablet, as recited in claim one, in which the cover tabs comprise fixed tabs that are able to attach to the base using a sliding movement of said tabs into the fixed tab receiving area defined by the base, until the retaining post moves through a defined aperture in the tab, and are removable only through intentional effort made to remove the tabs from the base by first lifting the tab away from the retaining post, and then sliding the tab out of the receiving area.

7. An improved reusable writing tablet, as recited in claim one, in which the cover tabs comprise detachable tabs that are able to attach to the base using a sliding movement of said tabs into the detachable tab receiving area defined by the base, and are removable through a lifting of the tab off of the retaining post and clear of the removable tab receiving area.

8. An improved reusable writing tablet, as recited in claim one, in which the cover tabs comprise a combination of fixed tabs and removable tabs, where said tabs are able to attach to the base using a sliding movement of said tabs into the tab receiving area defined by the base until the retaining post is able to move through the aperture defined by the tab, and are removable through a lifting of the tab off of, and away from their respective retaining posts.

9. An improved reusable writing tablet, as recited in claim one, in which the means to hold the detachable cover tabs against the base comprise a detachable tab holder area having set of flap retaining edges that are positioned with respect to the document support surface, so as to define flap insertion slits with sufficient width so as to allow the insertion of tab flaps, and a retaining post positioned between the flap retaining edges.

10. An improved reusable writing tablet, as recited in claim one, in which the tab holder means, defined by the base, includes a tab detachment finger notch, where said notch is located immediately below the area occupied by a detachable tab, so as to allow contact with the user's finger with the tab, which is lifted upward off of a retaining post for removal.

11. An improved reusable writing tablet, as recited in claim one, in which the cover has the ability to have marks made upon it, with said marks able to be removed or erased from the cover as needed.

12. An improved reusable writing tablet, as recited in claim one, in which the means to hold the fixed cover tabs against the base comprise a fixed tab holder area having a opposing set of fixed tab holder sidewalls that define the width of the document support surface within the fixed tab holder area, a retaining tab that protrudes outward from each said fixed tab holder side wall so as to define a narrowed opening into the fixed tab holder area, where said retaining tabs are positioned with respect to the document support surface so as to provide a gap through which the width of the cover tab can move through, and a retaining post positioned between the fixed tab holder sidewalls.

* * * * *